United States Patent [19]

Arieh et al.

[11] 4,353,551

[45] Oct. 12, 1982

[54] TENNIS RACKET WITH FRAME MOUNTED OSCILLATABLE WEIGHTS

[75] Inventors: Simon Arieh, Geneva; Jean-Pierre Budliger, Onex; Guy Courvoisier, Geneva, all of Switzerland

[73] Assignee: Battelle Development Corporation, Columbus, Ohio

[21] Appl. No.: 177,993

[22] Filed: Aug. 15, 1980

Related U.S. Application Data

[63] Continuation-in-part of Ser. No. 61,052, Jul. 26, 1979, abandoned.

[51] Int. Cl.[3] ..... A63B 49/04

[52] U.S. Cl. ..... 273/73 R; 273/73 C

[58] Field of Search ..... 273/73 R, 73 C, 73 G, 273/73 H, 73 J, 78, 169, 170; 124/23 R, 24 R; 145/29 B, 61 M

[56] References Cited

U.S. PATENT DOCUMENTS

| | | | |
|---|---|---|---|
| 1,526,734 | 2/1925 | Andrews et al. | 273/73 J X |
| 1,825,244 | 9/1931 | Nero | 273/170 |
| 3,172,438 | 3/1965 | Gianelli | 273/170 X |
| 3,757,761 | 9/1973 | Izuta | 124/23 R |
| 3,801,099 | 4/1974 | Lair | 273/73 C |
| 3,941,380 | 3/1976 | Lacoste | 273/73 R X |
| 4,057,250 | 11/1977 | Kuban | 273/73 R X |
| 4,174,110 | 11/1979 | Yamamoto | 273/169 |
| 4,182,512 | 1/1980 | Kuebler | 273/73 C |

*Primary Examiner*—Anton O. Oechsle

*Attorney, Agent, or Firm*—Barry S. Bissell

[57] ABSTRACT

A tennis racket comprises dynamic weights (6) distributed symmetrically relative to the longitudinal axis of the racket between the throat and the transverse axis of the head and suspended by arcuate straps (7) glued to the racket frame (2), the weights being displaceable in a direction perpendicular to the plane of the stringed area (3). The combination of weights and straps is adapted for having an intrinsic vibration frequency about 1.4 to 2 times the fundamental vibration frequency of the racket, such that when the weights are vibrated at their intrinsic frequency (by a ball striking the racket), the vibration of the racket is damped by energy transfer to the weights, and yet energy is also returned to the racket as a reaction in the direction of the ball's flight before the ball leaves the racket. The angular stability of the racket is improved over either fixed weights or dynamic weights having frequencies outside the critical range.

5 Claims, 6 Drawing Figures

FIG. 4
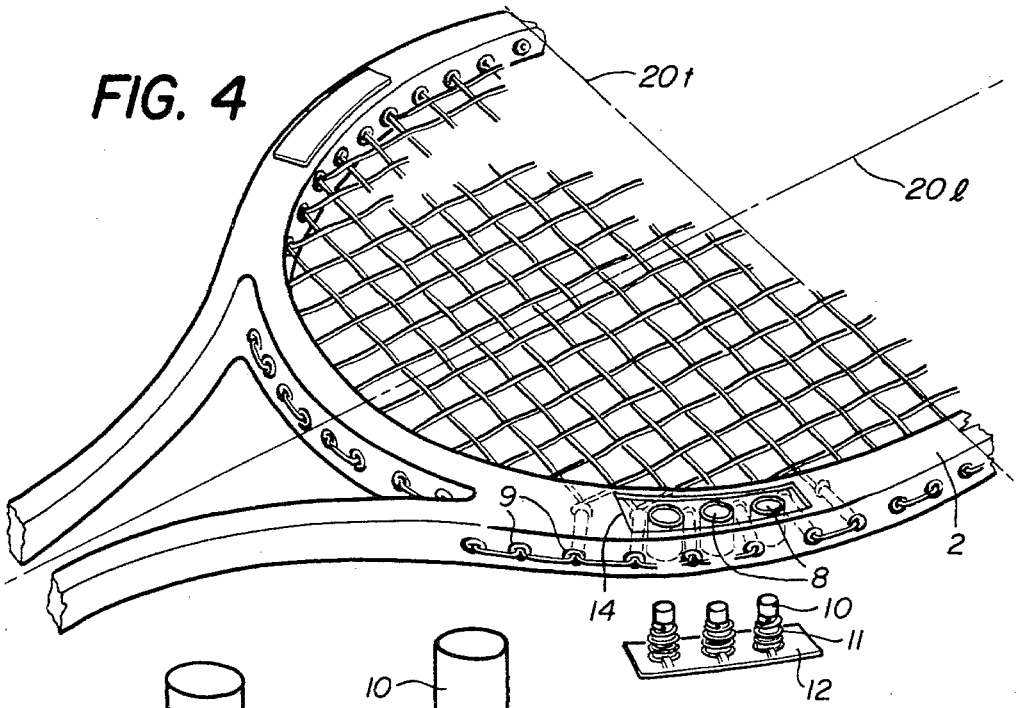
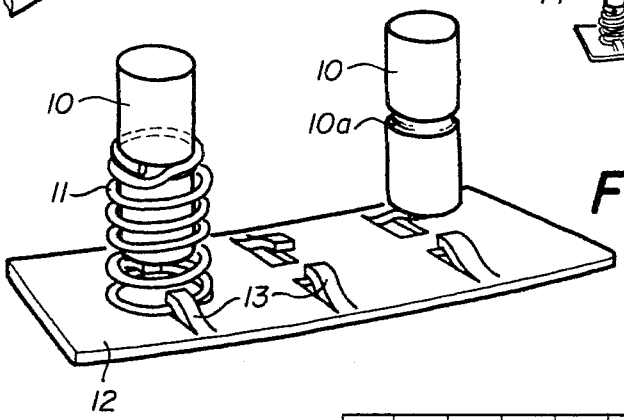
FIG. 5
FIG. 3
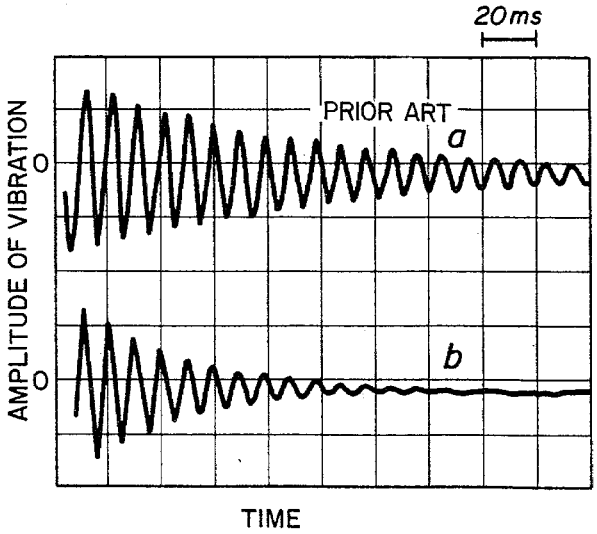

TENNIS RACKET WITH FRAME MOUNTED OSCILLATABLE WEIGHTS

RELATED APPLICATION

This application is a continuation-in-part of our patent application United States Ser. No. 61,052 filed July 26, 1979, now abandoned.

TECHNICAL FIELD

The present invention concerns a tennis racket having an increased moment of inertia around the racket handle axis and improved means for damping the vibration of the racket caused by off-center impact.

BACKGROUND ART

Various methods have been proposed to improve ball control on tennis rackets. Generally, the object of the methods is to increase the effective hitting area of the head (sweet spot or center of percussion). Thus, U.S. Pat. No. 3,999,756 discloses a tennis racket, the construction of which is adapted to increase the string area, thus giving a high restitution coefficient.

Another method having the same kind of object is disclosed in U.S. Pat. No. 3,801,099 (Lair) which concerns a tennis racket with a low weight to stiffness ratio and the head frame of which is shaped in order that the longer axis of the head ellipse is perpendicular to the handle axis; this arrangement increases the moment of inertia around the racket handle axis.

U.S. Pat. No. 3,907,292 concerns a tennis racket the rim and the handle of which are surrounded by a tubular organ containing a series of fly-weights which normally rest in the throat portions of the tube due to the action of helical springs. Under use, the weights move toward the head of the racket because of the centrifugal force resulting from the racket swinging motion during play and increase the "sweet spot" of the stringed area; this also ensures a better bouncing control on the ball and an increased hitting power.

U.S. Pat. No. 3,941,380 (Lacoste) discloses a tennis racket in which the head oscillations are damped by means of a secondary oscillator working along the handle axis thereof at vibration antinodes. Since the oscillating bodies are located on the longitudinal axis of the racket, they do not affect the center of percussion and do not reduce the torque around the axis which results from an off-centered impact.

U.S. Pat. No. 4,057,250 (Kuban) discloses means to generate a reactive force for diminishing the bouncing of the racket after ball impact. For achieving this, masses producing the force must be able to move as freely as possible and, in this connection, the masses can even consist of loose metal shot. Thus, the device is not a secondary oscillator. The effect is distinguishable from the present invention since the increase of the moment of inertia of the racket in Kuban will only take place when the body has reached the end of its free elastic displacement which may be too late after the impact for being effective to increase the center of percussion. Moreover no damping of vibration is contemplated by an oscillator.

Another reference, French Pat. No. 2,387,670, concerns a golf club, the head of which is provided with balancing weights which can vibrate in a direction perpendicular to the longitudinal axis of said head. This oscillating motion ensures that the orientation of the head is maintained during the interval starting from the moment the ball is hit by the head to the moment it loses contact therewith after being hit. The balancing weights increase the moment of inertia of the club in relationship to the hitting point of the head. Thus, these weights have first a static effect because they increase the club inertia and, second, they have a dynamic effect because they move in a direction perpendicular to the hitting plane of the head. Such displacements generate moments of inertia around the striking point which are substantially equal and enable the head to stay properly oriented after striking the ball, this action being effective for the full distance where the head and the ball stay in contact.

DISCLOSURE OF THE INVENTION

The object of the present invention is to increase the moment of inertia and the area of the "sweet spot" or center of percussion both longitudinally and transversely on a tennis racket to increase a players chance of striking the center, and at the same time to ensure the damping of the oscillation of the racket when the ball is nevertheless struck off-center.

It is also an object to provide a tennis racket with improved angular stability over standard rackets, or those with static weights, on off-centered impacts.

It is further an object to temporarily store some of the impact (vibrational) energy of the racket transferred from the impacting ball in oscillating weights whereby to attenuate racket vibration but to also return at least a portion of such energy to the racket, and subsequently the ball, before the ball leaves the racket.

The invention provides a tennis racket having moveable or dynamic weights attached to the rim of the racket's head on both sides relative to the handle of the racket between the racket throat and the transverse axis of the head. The position of these weights increases the moment of inertia around both the longitudinal and transverse axes of the racket effectively enlarging the sweet spot or center of percussion in all directions. The moveable weights are coupled to said rim by elastic means whereby they can oscillate in a direction substantially perpendicular to the plane of the racket head with an intrinsic frequency 1.4–2 times that of the fundamental frequency of oscillation of the racket itself. This arrangement provides an unique weighting system chosen in a manner such that when the system consisting of the moveable weights and the elastic means is driven into vibration at the frequency 1.4–2 times that of the racket, the weights complete the first half of their cycle and apparently restore energy to the racket before the ball leaves the racket. Moreover, the moveable weights with this critical frequency improve the angular stability of the racket over fixed weights or dynamic weights without the critical frequency.

BRIEF DESCRIPTION OF THE DRAWING

FIG. 3 is a comparative diagram of the vibration in two rackets of the same type, one of which is provided with the moveable weights according to the invention.

FIG. 4 is a perspective view of an alternative configuration of the present invention.

FIG. 5 is a perspective view at a greater scale of the weight system of FIG. 4.

BEST MODE OF CARRYING OUT THE INVENTION

Figure 1:
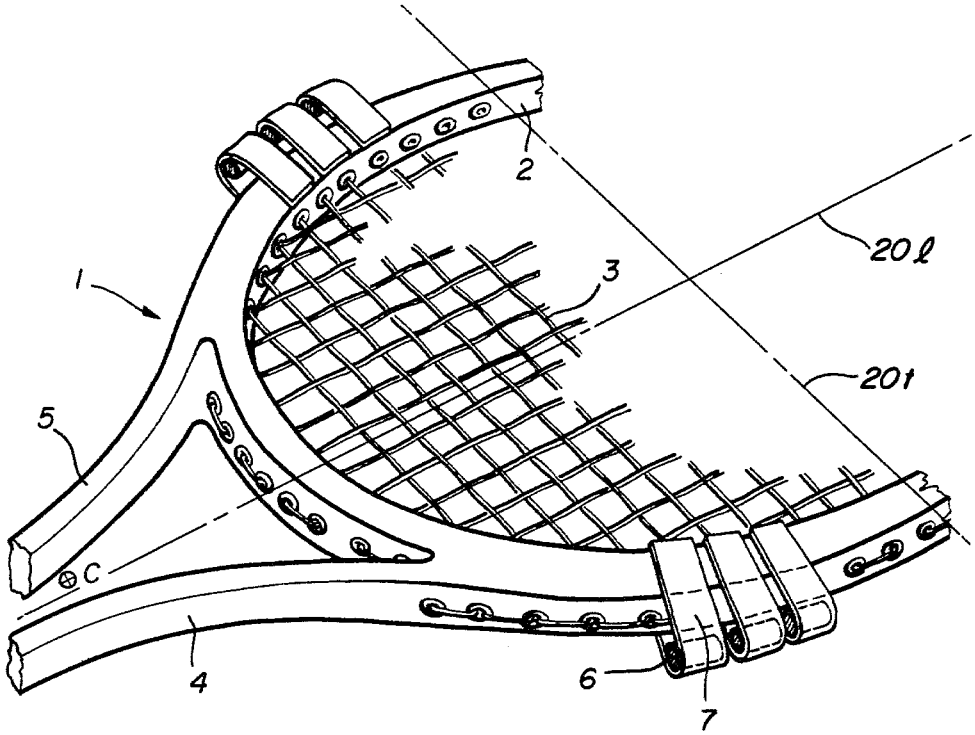
FIG. 1 is a view partially in perspective of one embodiment of the invention using weights held in moveable straps.

FIG. 1 shows a conventional tennis racket 1 comprising the head 2, the strings 3 attached to the head 2 and two side members 4 and 5 forming the throat of the racket connecting the head to the handle (not pictured). The longitudinal and transverse axes are along lines $20_l$ and $20_t$ respectively. The racket comprises six moveable weights 6, consisting in this example of small cylinders of about 3 g each, which are coupled to the head 2 by means of straps 7. The straps 7 consist of energy absorbent polyurethane or equivalent elastomer, 1 mm thick, glued at the top of the arcuate section of each strap on the underside thereof to the frame. These straps 7 constitute elastic means for allowing movement of the weights generally perpendicular to the plane of the racket head. The system composed of the straps and the moveable weights has an intrinsic oscillatory frequency and constitutes, with the racket itself, a two-section oscillator chain, each oscillator starting to vibrate with its own independent oscillating frequency whenever a ball impacts the racket strings 3. The straps and/or the weights are made of energy absorbent materials which may aid the damping of the racket vibration in addition to the attenuating effect of the oscillator chain.

Figure 6:
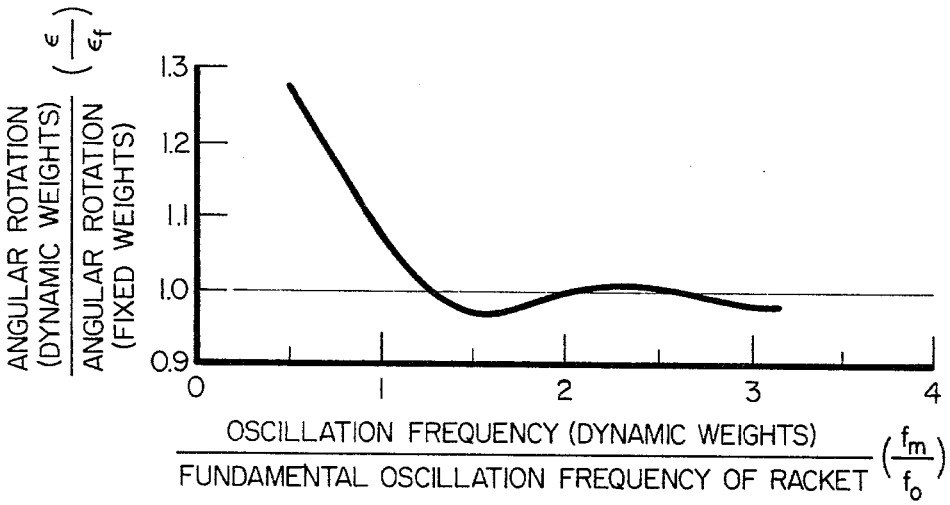
FIG. 6 is a graph showing the improvement in angular stability due to moveable weights having the critical intrinsic frequency range.

The moveable weights have multiple effects. The first effect of the weights 6 is to increase the moment of inertia of the racket around both the longitudinal and transverse axes of the racket and to increase the angular stability to an off-centered impact of a ball on the racket. Static weights would have a similar effect in increasing the effective size of the center of percussion, popularly known as the "sweet spot" of the racket, but the moveable weights, with the critical frequency, improve the angular stability over static weights as shown in FIG. 6. The ordinate of the graph in FIG. 6 is the ratio of the angular rotation for moveable weights over that for static weights. The abscissa shows the ratio of the intrinsic frequency of the weight system to the fundamental frequency of the racket. This analytical curve shows that over the frequency range of about 1.3–2 and also above 2.7, the angular stability is up to about 3% better with moveable weights than fixed weights. We believe that between 1.3 and 1.4 and above 2.7 the angular stability is improved, but these ranges are not ideal based on the other properties discussed later.

In practice, it is naturally advisable that the additional weights be as light as possible relative to the racket so as not to impose an additional burden on the player. For example, it is preferred that the weights make a total of about 20 g.

The location of the weights must also be optimized in connection with the center of gravity and the moment of inertia of the racket. Placement of the weights as far as possible away from the longitudinal axis would maximize the moment of inertia but would require a larger compensating weight in the handle to retain the center of gravity at about point C in FIG. 1, thereby increasing the total weight of the racket. Placement nearest the throat would require minimal compensating weight but would not have much effect on the sweet spot in the transverse directions. A compromise is preferably struck, according to the invention, by symmetrically locating the weights on the rim at angles between about 30 and 70 degrees from the longitudinal axis on both sides thereof between the transverse axis and the throat. This position also has the advantage that the sweet spot of the racket is elongated in both the longitudinal and the transverse directions of the racket thereby increasing the possibility of a good return of a tennis ball.

Figure 2:
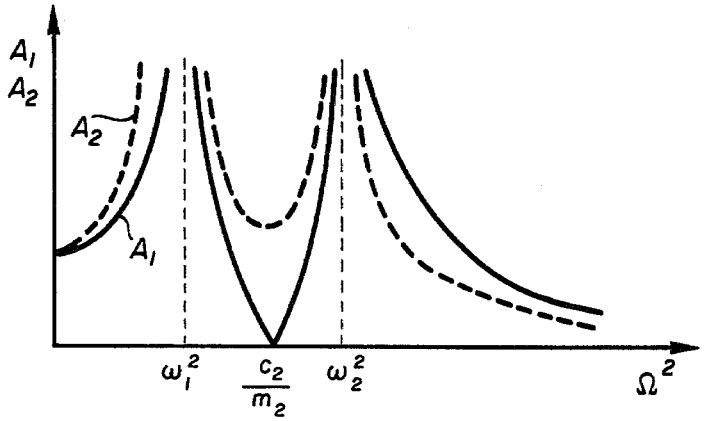
FIG. 2 is a diagram showing the damping effect of a two-section oscillator chain which we believe may help explain the invention.

The second and third effects of the weights are to damp racket vibration after impact and to restore a small but significant portion of the impact energy to the racket while the ball is still in contact. The reason for the energy restoration is complicated and not easily explained. However, according to one theory, which we believe may be used to analyze the situation, the absolute values of the amplitudes $A_1$ and $A_2$ related to a two-section oscillator chain system, as proposed for the present case, are related to the impact excitation frequency $\Omega$ as schematically represented on the diagram of FIG. 2. The magnitudes of the amplitudes $A_1$ and $A_2$ correlate with the amplitudes of the vibration of the racket and of the displacement of the weights 6, respectively. It can be shown that, on the abscissa, the zero position of the function $A_1(\Omega^2)$ is satisfied when:

$$\Omega = \left(\frac{c_2}{m_2}\right)^{\frac{1}{2}} \tag{1}$$

in which $c_2$ is the spring constant of the elastic means 7 for suspending the weights 6 and $m_2$ is the mass of the weights 6. Thus, in principle, if the excitation has a frequency $\Omega$ equal to the intrinsic vibration frequency of the $c_2$, $m_2$ system, then $m_1$ which constitutes the mass of the racket stays at rest. Although this would be ideal for reducing vibration, it would not help angular stability and energy restoration. However, using this equation, it is also possible to select the appropriate spring constant of the suspending means 7 of the moveable weights 6 such that the individual frequency of said weights corresponds to that multiple of the frequency of the first mode of intrinsic vibration $\omega_1$ of the racket taken alone which optimizes the vibration attenuation with the angular stability and other desired properties.

As an example of a calculation of the necessary spring constant using this theory, the oscillation period $T_1$ of the racket was measured by means of a strain gauge placed on a sample racket and was found to be 0.01 sec. Therefore $f_1 = 1/T_1 = 100$ Hz and $\omega_1 = 628.3\ \text{sec}^{-1}$ We have calculated that in order to temporarily store impact energy in the suspended masses and to then restore a portion of the impact energy to the racket before the ball leaves, it will be necessary to have the elastically suspended masses located on the opposite side of the racket relative to the ball at the moment the ball leaves the racket. We have found that this requires that the frequency, $\omega_2$, of the weight system be related to the first mode of the racket frequency, $\omega_1$, such that:

$$1.4\omega_1 \leqq \omega_2 \leqq 2.0\omega_1 \tag{2}$$

Using equations (1) and (2) for a 3 gram (weight), the spring constant $c_2$ must be between about 235 g (force)/mm and 485 g (force)/mm to ensure damping and restoration of energy to the racket prior to the impacting ball leaving the racket. The energy restored by two weight systems, each consisting of 3 three-gram weights secured by three straps having spring constants in the range calculated above and weighing a total of one gram (therefore 2 ten gram weight systems), would be on the order of 2%, a seemingly small yet significant gain.

Weights 6 and straps 7 having the properties determined above were divided into two groups, each group of three weights being located symmetrically on one side of the longitudinal axis of the racket such as shown in FIG. 1, at an angle of about 45° to the longitudinal axis. Various experiments and measurements have been performed on this racket. Firstly, comparative measurements have been effected on two identical rackets, one of them being provided with the added weights of the invention, the other being unmodified. Vibration damping coefficients on both rackets were measured. FIG. 3 represents two diagrams, "a" and "b", of the damping of the vibrations, curve "a" corresponding to the control racket without the weights and curve "b" corresponding to the racket equipped with two groups of ten gram weights (three 3 g weights held by a 1 g strap). It can be seen that the damping rate of "b" is much faster than "a" as impact energy is transmitted to the moveable weights and the energy absorbing materials and then has been partially restored to the racket on the first cycle of the weights.

Thereafter, playing trials were carried out by several tennis players who generally noted that racket "b" provided a better control of the ball especially in the case of overspin or sliced balls, i.e. when the surface of the racket is at a nonorthogonal angle with the path of the incoming ball.

Since the reports of the players were possibly subjective and did not provide quantitative results and definite explanation in connection with the practical behavior of the modified racket, laboratory experiments were performed. For such experiments, the racket was attached to a bench support so as to provide a certain degree of elastic rotational freedom around the handle axis. This was intended to simulate the rotational allowance of a racket when handled by a player in actual play and its resistance to the torque produced by the impact of the ball. Balls were projected horizontally on the racket by means of a tube operated by a spring. The movements of the racket and ball were recorded with a very high-speed camera and the pictures showed that the contact time of the ball and the racket of the invention was about 20% greater than with the control racket. Further, it was found that the half period of vibration of the added weights, which corresponds to their return to their initial position, corresponds to about 60–70% of the contact time of the ball and the racket during the impact. Consequently, we have found that, as the weights move to the opposite side of the racket relative to the ball, energy temporarily stored in the moving weights is restored to the racket when the ball is still touching the strings. And the contact time is increased leading to better ball control. Moreover, after impact, the inventive weight system attenuates the vibration better than fixed weights and only slightly less effectively than moveable weights having frequencies equal to the fundamental mode of vibration of the racket.

The increase of the time of contact between the strings and the ball provides a better control of the overspin or cut shots and reduces the slipping of the ball when it leaves the racket. This is actually an essential condition for an accurate control of the force and rotation imparted to the ball and of the direction of its path. Neither fixed weights nor moveable weights having frequencies outside the critical range combine this increased contact time with improved angular stability and vibration attenuation.

It is not altogether clear why better vibration attenuation and the restoration of some impact energy is obtained while the ball is still in contact with the racket. However, one theory which may explain our observations is as follows. Tests show that the fundamental racket vibration is best attenuated with dynamic masses having the same frequency as the racket fundamental frequency. This would be the case after the ball leaves the racket. But we believe that during the ball contact, which only lasts for about the first half period of the racket vibration, the fundamental mode of vibration may not be established and that the vibration zone during wave expansion is smaller than the entire length of the racket, therefore, momentarily establishing random higher frequencies than the fundamental. This means that efficient attenuation may then be obtained during the time of ball contact with dynamic masses having a higher frequency than the racket fundamental frequency.

We have found experimentally that a frequency between 1.4 and 2 times higher is such a condition which yields the improved performance. Moreover, the random higher frequency vibrations may be responsible for forcing the ball off the racket too early and therefore the attenuation thereof may explain the increased contact time with the invention. Of course, after the ball leaves, the attenuation is not as good as it would be with less stiff attachment of the weights, but the improved ball control appears to be worth the sacrifice. However, regardless of the reason we have observed that the properties of the racket discussed above are improved with dynamic masses having the stiffer attachment.

The modification shown in FIG. 4 and FIG. 5 illustrates a racket embodiment according to the invention in which the weights and the suspending elastic means are incorporated within the frame of the head. Suitable adsorbent materials can be used in their construction. This frame, which is somewhat enlarged to accommodate the weights and springs, comprises three tubular housings 8 the axis of which are perpendicular to the plane of the head. The stringing holes 9 are distributed in this area of the frame between the housings 8. Each housing 8 is adapted for accommodating one of the weights, which are in the form of small cylinders 10, for example weighing 3 g, and having each an annular groove **10*a* in their side wall. The cylindrical weights 10 are mounted axially within a helical spring 11, the end winding of which is crimped around the groove 10*a* and the first winding of which is set to a general base plate 12 by means of two strips 13 stamped in said plate 12. The assembly of the three weights 10 and the springs 11 is assembled by putting each weight into its tubular housing 8, the base plate being inserted in a hollow area (not visible) located at one end of said housings 8. Another identical plate (not shown) is inserted in another similar hollow area 14 of the other side of said housings. In this modification, the presence of the added weights assembly is hardly visible from the outside except for the slight widening of the frame side where the housings 8** are incorporated; thus, the racket of this modification is hardly distinguishable from an unmodified racket. Weight of the cylinders and stiffness of the springs are selected as in the case of the straps discussed above.

Total added weight of about 20 grams is preferred. The important feature, however, is the frequency of the added mass/spring assembly.

It should be noted that the cost of such a racket is not much over that of an ordinary racket since there are only 11 additional parts on each side relative to the handle: three tubes, three weights, three springs and two plates. The installation of these parts can be achieved easily and can be adapted to partially automatic manufacturing techniques.

We claim:

1. An improved tennis racket having a predetermined fundamental vibrational frequency comprising a frame head, a throat, a handle and strings across the frame head and including dynamic weights on the frame head for expanding the center of percussion in the plane of the strings, improving angular stability and for initially absorbing ball impact energy and thereby damping impact vibrations on the racket but then restoring at least a portion of the absorbed impact energy to the racket while the ball is still contacting the strings characterized in that the weights are coupled to the racket frame head by elastic means at locations on both sides of the longitudinal axis of the frame head between the racket throat and the transverse axis of the head, said elastic means having a predetermined elasticity and orientation such that the weights oscillate in a direction substantially perpendicular to the plane of the strings with an intrinsic frequency of about 1.4–2 times that of the fundamental vibrational frequency of the racket.

2. The tennis racket of claim 1 wherein the weights are symmetric with respect to the longitudinal axis.

3. The tennis racket of claim 2 wherein the total weights on each side of the longitudinal axis are equal in magnitude.

4. The tennis racket of claim 1 characterized in that the head comprises guide holes through the frame head perpendicular to the plane of the strings and wherein the elastic means are springs and the springs and weights are housed within the guide holes.

5. The tennis racket of claim 1 characterized in that the elastic means are straps.

* * * * *